US005261784A

United States Patent [19]

Weber

[11] Patent Number: 5,261,784

[45] Date of Patent: * Nov. 16, 1993

[54] VARIABLE PRESSURE PITOT PUMP

[75] Inventor: Kent Weber, Rockford, Ill.

[73] Assignee: Sundstrand Corporation, Rockford, Ill.

[ * ] Notice: The portion of the term of this patent subsequent to Aug. 4, 2009 has been disclaimed.

[21] Appl. No.: 605,428

[22] Filed: Oct. 30, 1990

[51] Int. Cl.[5] ..... F04D 1/14

[52] U.S. Cl. ..... 415/88; 415/89; 417/15; 188/161; 188/267

[58] Field of Search ..... 415/88, 89; 417/15; 188/267, 161, 162; 318/362, 370, 371, 375, 757

[56] References Cited

U.S. PATENT DOCUMENTS

| | | | |
|---|---|---|---|
| 2,440,624 | 4/1948 | Wemp | 415/89 |
| 3,512,618 | 5/1970 | Schafer | 188/161 |
| 3,791,757 | 2/1974 | Tarifa et al. | 415/89 |
| 3,930,744 | 1/1976 | Theis, Jr. | 415/88 |
| 4,110,670 | 8/1978 | Araki et al. | 318/757 |
| 4,267,964 | 5/1981 | Williams | 415/88 |
| 4,281,962 | 8/1981 | Erickson | 415/89 |
| 4,339,923 | 7/1982 | Hays et al. | 415/88 |
| 4,776,167 | 10/1988 | Kawamura | 415/177 |
| 4,788,463 | 11/1988 | Layh | 188/161 |
| 5,135,353 | 8/1992 | Westhoff | 415/88 |

FOREIGN PATENT DOCUMENTS

| | | | |
|---|---|---|---|
| 230159 | 11/1963 | Austria . | |
| 1513202 | 10/1989 | U.S.S.R. | 415/88 |

*Primary Examiner*—John T. Kwon

*Attorney, Agent, or Firm*—Antonelli, Terry, Stout & Kraus

[57] ABSTRACT

A pump (P) including a stationary pump housing (1) and a rotating pump housing (10, 10*a*) mounted on the stationary pump housing (1) and defining a fluid receiving chamber (11). A pitot probe (5) freely rotatably mounted in the stationary pump housing (1) and terminating in a tip portion (5*a*) disposed in the fluid receiving chamber (11). A brake arrangement (20, 21) is provided for braking a rotational speed of the probe (5) so as to enable a controlling of the rotational speed of the probe (5) independent of the rotational speed of the rotating pump housing (10, 10*a*) thereby producing variable pump pressures and fluid flow rates for the pump (P).

6 Claims, 1 Drawing Sheet

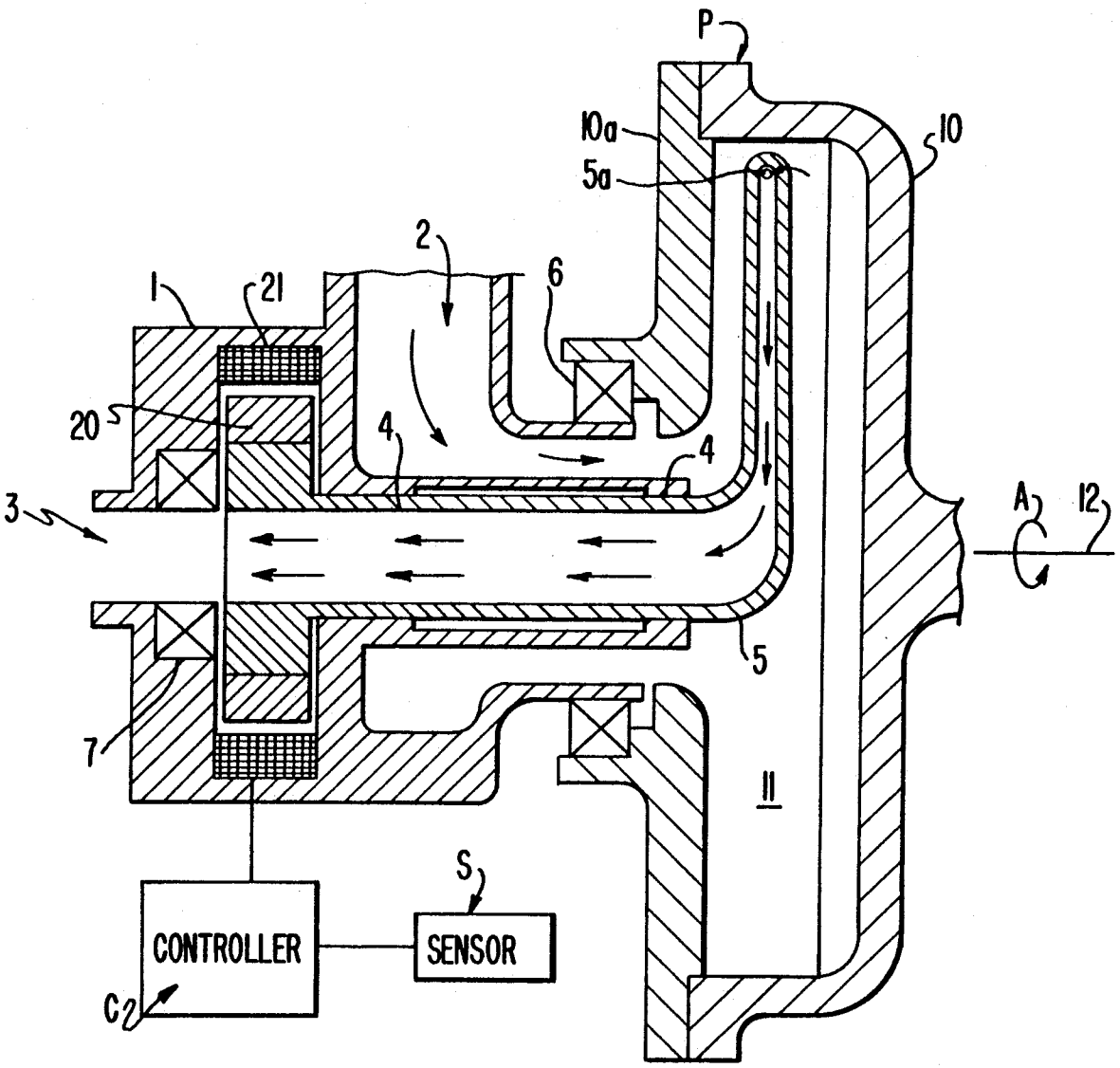
12
A
10
P
10a
5a
6
2
21
1
20
3
4
4
5
11
7
S
SENSOR
CONTROLLER
C

VARIABLE PRESSURE PITOT PUMP

TECHNICAL FIELD

The present invention relates to a pump arrangement and, more particularly, to a pitot pump arrangement having a variable speed in order to permit the pitot pump to produce variable pressures and variable flow rates.

BACKGROUND ART

In certain applications, such as, for example, a fuel pump for an aircraft, it is desirable to vary an output pressure and flow of a centrifugal pump independently of the speed.

In aircraft fuel pumps, it is a conventional practice to throttle, recirculate or bypass the flow of the pump so as to vary the output pressure and flow thereof; however, this conventional approach results in unacceptable fuel temperature rise due to the poor efficiency of the approach and results in high power dissipation of the required flow controlling means.

Various pumps or pump-like arrangements utilizing a pitot tube or similar element have been proposed in, for example, U.S. Pat. Nos. 2,440,624, 3,791,757, 3,930,744, 4,267,964, 4,281,962, 4,339,923 and Austrian Patent 230,159.

While the above proposed constructions provide diverse technical approaches for pumps or liquid handling arrangements, none of the proposed constructions are suitable for use as, for example, an aircraft fuel pump nor capable of varying an output pressure and flow of the centrifugal pump independently of the speed thereof.

DISCLOSURE OF INVENTION

The aim underlying the present invention essentially resides in providing a pump arrangement employing a pitot tube which is adapted to rotate independently of a pump shaft speed when reduced pressure and flow is desired.

An object of the present invention resides in providing a pump arrangement for low specific speed and low NPSH (Net Positive Suction Head) application such as, for example, in an aircraft fuel pumping system.

Yet another object of the present invention resides in providing a pump arrangement employing a rotating pitot probe, with the relative speed of the probe being selectively controllable so as to provide a pump pressure and flow control capabilities independent of a shaft speed of a pump housing of the pump.

In accordance with advantageous features of the present invention, a pump is provided which comprises a stationary pump housing and a rotating pump housing mounted in the stationary pump housing and defining a fluid receiving chamber. A pitot probe means is freely rotatably mounted in the stationary pump housing and terminates in a tip portion disposed in the fluid receiving chamber. The selective control means are adapted to brake a rotational speed of the probe means so as to enable a controlling of the rotational speed of the probe means independently of the rotational speed of the rotating pump housing thereby producing the variable pump pressures and fluid flow rates for the pump.

The selective control means are advantageously fashioned as a selectively operable brake means for applying braking forces on the probe means in dependence upon the desired pump pressure and fluid flow rate.

Advantageously, the brake means is fashioned as an electric brake means including a plurality of magnets disposed about an outer periphery of a portion of the probe means disposed in the stationary pump housing opposite the tip portion of the probe means, with coil means being disposed in opposition to the magnets and cooperable therewith, and with control means controlling an energization of the coil means and thereby the braking force applied to the probe means.

The pump of the present invention is advantageously constructed as a fuel pump and is readily adapted to be utilized as a fuel pump in an aircraft fuel pumping system.

The above and other objects, features, and advantages of the present invention will become more apparent from the following description when taken in connection with the accompanying drawings which show, for the purpose of illustration only, one embodiment in accordance with the present invention.

BRIEF DESCRIPTION OF THE DRAWINGS

The single FIGURE of the drawing is a axial cross sectional view of a variable pressure pump employing a pitot probe constructed in accordance with the present invention.

BEST MODE FOR CARRYING OUT THE INVENTION

Referring now to the Single FIGURE of the drawing, according to this FIGURE, a fluid pump generally designated by the reference character P is provided including a stationary housing 1 and a rotating housing fashioned, for example, of interconnected housing members 10, 10*a*. The rotating housing 10, 10*a* is adapted to rotate, for example, in the direction of the arrow A about a rotational axis 12. The stationary housing 1 includes a conventional bearing support arrangement 4 for freely rotating a pitot tube 5. An inlet seal 6, of a conventional construction, is provided at an inlet end of the stationary housing 1, with an outlet seal 7, also of conventional construction, being provided at the outlet end of the stationary housing 1.

The pitot tube 5, freely rotatably supported by the bearing support 4, terminates in a pick up head or probe tip 5*a* disposed in a cylindrical chamber 11 defined by the rotating housing parts 10, 10*a*. The fluid to be pumped, for example, fuel, is introduced into the chamber 11 through the fluid inlet port 2. A maximum pressure of the pump P is developed at the pick up head or probe tip 5*a* and at the pump outlet when the probe 5 is prevented from rotating. When the probe 5 is permitted to rotate freely, the rotational speed of the probe 5 will be substantially equal to the rotational speed of the housing 10, 10*a* and, consequently, no pressure develops at the pick up head or probe tip 5*a* or at the pump outlet 3.

In order to enable a control of the rotational speed of the probe 5 so as to permit the probe 5 to rotate at selected intermediate speeds thereby generating desired intermediate pump outlet pressures, in accordance with the present invention, a brake arrangement is provided for selectively braking the rotation of the probe 5. The brake mechanism may, for example, include a plurality of magnets 20 disposed about a periphery of the end of the probe 5 opposite the pick up head or tip 5*a*. Coils 21 are mounted in the stationary housing 1 in opposition to the magnets 20 such that the magnets 20 pass the coils 21 as the probe 5 rotates. Thus, the magnets 20 and coils 21 form an electric brake, with the braking force being selectively alterable by applying current to the coils 21 thereby enabling a control of the rotational speed of the probe 5.

The energization of the coils 21 may, for example, be controlled by a conventional controller C responsive to pressure or flow signals of a fluid consumer (not shown) to which the pump P is connected, with the pressure or flow signals being detected by a conventional sensor S.

While the illustrated embodiment employs an electric brake utilizing magnets 20 and coils 21, it is understood that a friction brake arrangement (not shown) or a hydrodynamic brake arrangement (not shown) could readily be employed to provide the desired braking action of the probe 5, with the controller C being adapted to provide the necessary control signals to activate the friction clutch arrangement or adjust the hydraulic pressure to the hydrodynamic brake arrangement to provide the desired braking force for braking the rotational speed of the probe 5.

In order to maximize part load efficiency, it is also possible in accordance with the present invention to replace the dissipative braking mechanism such as the electric brake, friction clutch arrangement or hydrodynamic brake, with an arrangement for producing useful work such as, for example, a gear or vane pump (not shown) driven by probe 5. Fluid output of the gear or vane pump could be added in series or in parallel to the output of the pump P flowing through the fluid outlet port 3 as desired so as to achieve overall pump characteristics most suited to a particular application.

The pump P with the pitot probe 5 arranged in the manner described hereinabove is an excellent choice for a pumping mechanism for a low specific speed low NPSH application such as required for an aircraft fuel pumping system. By permitting the probe 5 to rotate at a controlled speed, it is possible for the pump P to exhibit pressure and flow control capabilities independent of the shaft speed of the rotating pump housing 10, 10*a*.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A pump comprising a stationary pump housing, a rotating pump housing mounted on said stationary pump housing and defining a fluid receiving chamber, a pitot probe means freely rotatably mounted in said stationary pump housing and terminating in a tip portion disposed in said fluid receiving chamber, and means for selectively controlling a braking of a rotational speed of the probe means so as to enable a controlling of the rotational speed of the probe means independently of a rotational speed of the rotating pump housing thereby providing variable pump pressures and fluid flow rates for the pump.

2. A pump according to claim 1, wherein said means for selectively controlling includes a brake means for applying braking forces on the probe means in dependence upon the desired pump pressure and fluid flow rate.

3. A pump according to claim 2, wherein said brake means is an electric brake means.

4. A pump according to claim 3, wherein said electric brake means includes a plurality of magnets disposed about an outer periphery of a portion of the probe means located in the stationary pump housing opposite the tip portion of the probe means, coil means disposed in opposition to the magnets and cooperable therewith, and control means for controlling an energization of the coil means and thereby the braking force applied to the probe means.

5. A pump according to claim 4, wherein the pump is a fuel pump.

6. A pump according to claim 5, wherein the fuel pump is disposed in an aircraft fuel pumping system.

* * * * *